US006416656B1

(12) United States Patent
Zhang et al.

(10) Patent No.: US 6,416,656 B1
(45) Date of Patent: Jul. 9, 2002

(54) CATALYTIC CRACKING PROCESS FOR INCREASING SIMULTANEOUSLY THE YIELDS OF DIESEL OIL AND LIQUEFIED GAS

(75) Inventors: Jiushun Zhang; Anguo Mao; Xiaoxiang Zhong; Zhigang Zhang; Zubi Chen; Yamin Wang; Wei Wang; Shuxin Cui; Zeyu Wang; Hua Cui; Ruichi Zhang, all of Beijing (CN)

(73) Assignees: China Petrochemical Corporation; Research Institute of Petroleum Processing, Sinopec, both of Beijing (CN)

( * ) Notice: Subject to any disclaimer, the term of this patent is extended or adjusted under 35 U.S.C. 154(b) by 0 days.

(21) Appl. No.: 09/602,568

(22) Filed: Jun. 22, 2000

(30) Foreign Application Priority Data

Jun. 23, 1999 (CN) ..... 99109195

(51) Int. Cl.[7] ..... C10G 11/00

(52) U.S. Cl. ..... 208/113

(58) Field of Search ..... 208/113, 120.01, 208/153, 157

(56) References Cited

U.S. PATENT DOCUMENTS

| | | | | |
|---|---|---|---|---|
| 3,758,403 A | | 9/1973 | Rosinski et al. | 502/67 |
| 3,784,463 A | | 1/1974 | Reynolds et al. | 208/74 |
| 3,894,932 A | | 7/1975 | Owen | 208/74 |
| 3,948,757 A | * | 4/1976 | Strother | 208/74 |
| 4,218,306 A | * | 8/1980 | Gross et al. | 208/120 |
| 4,309,280 A | | 1/1982 | Rosinski et al. | 208/120.01 |
| 4,422,925 A | | 12/1983 | Williams et al. | 208/75 |
| 4,869,807 A | * | 9/1989 | Krishna | 208/120 |

(List continued on next page.)

FOREIGN PATENT DOCUMENTS

| | | |
|---|---|---|
| CN | 1 031 834 A | 3/1989 |
| CN | 1 004 878 B | 7/1989 |
| CN | 1 034 949 A | 8/1989 |
| CN | 1 043 520 A | 7/1990 |
| CN | 1 085 885 A | 4/1994 |
| CN | 1 160 746 A | 10/1997 |
| EP | 0 369 536 A | 5/1990 |

OTHER PUBLICATIONS

Zaiting, L. et al. (Sep. 25, 1989). "Production of gaseous olefins by catalytic conversion of hydrocarbons," *Chemical Abstracts* 111(13) Abstract No. 115908e, corresponding to European Patent Application No. 0,305,720 and Chinese Patent No. 1 004 878B (Chinese Patent Application No. 87 105 428), pp. 11–12.

Mauleon, J.L. et al., (Mar. 5, 1990). "Procedure and apparatus for hydrocarbon conversion in fluidized bed," *Chemical Abstracts* 112(10) Abstract No. 80784c, corresponding to European Patent Application No. 0,323,297 and Chinese Patent No. 1,034,949A, p. 205.

*Primary Examiner*—Nadine Preisch
(74) *Attorney, Agent, or Firm*—Morrison & Foerster LLP

(57) ABSTRACT

This discloses a process for catalytically cracking hydrocarbon stocks in a riser or fluidized bed reactor simultaneously to increase yields of diesel and liquefied gas. The process includes the steps of: first, charging a gasoline stock and a catalytic cracking catalyst into a lower zone of the reactor to permit contact between the catalyst and the gasoline stock and to produce a liquefied gas-rich oil-gas mixture containing reacted catalyst. The resulting liquefied gas-rich oil-gas mixture (still containing reacted catalyst) is then introduced into a reaction zone above the lower zone of the reactor. Simultaneously, at least one conventional catalytic cracking hydrocarbon feed is also fed independently into at least two sites is situated at a different height above the lower zone of the reactor. The resulting mixture is then separated in a conventional fashion.

26 Claims, 1 Drawing Sheet

U.S. PATENT DOCUMENTS 4,980,053 A 12/1990 Li et al. ..... 208/120.01
5,098,554 A * 3/1992 Krishna et al. ..... 208/113
5,264,115 A 11/1993 Mauleon et al. ..... 208/67
5,310,477 A * 5/1994 Lomas ..... 208/78
5,326,465 A 7/1994 Yongqing et al. ..... 208/120.01
5,506,365 A * 4/1996 Mauleon et al. ..... 585/329
5,616,237 A * 4/1997 Krishna et al. ..... 208/120
5,846,403 A 12/1998 Swan et al. ..... 208/113
5,965,012 A * 10/1999 Lomas ..... 208/113
RE36,403 E * 11/1999 Krishna ..... 208/120.01

* cited by examiner

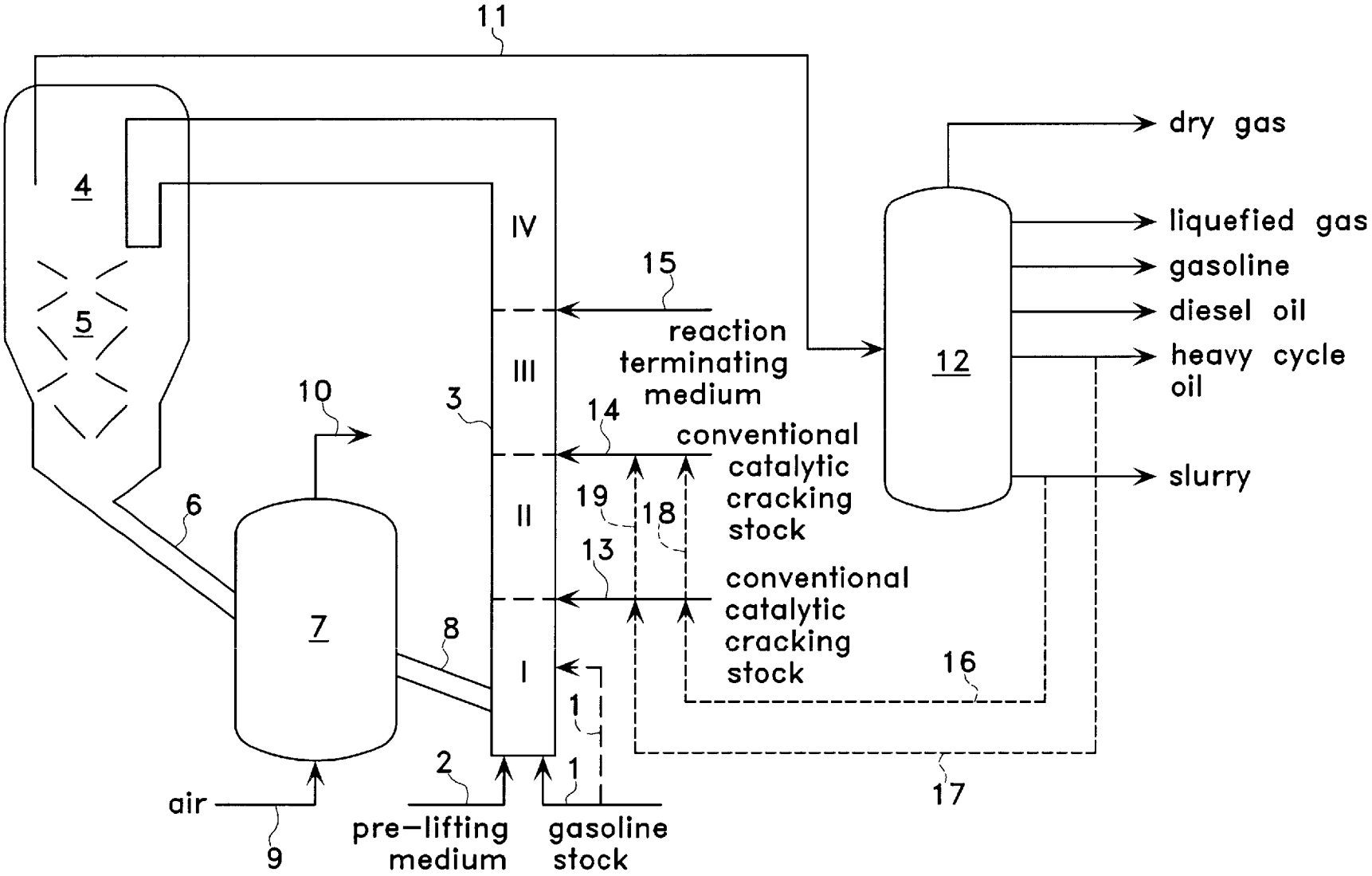
dry gas
liquefied gas
gasoline
diesel oil
heavy cycle oil
slurry
12
16
17
conventional catalytic cracking stock
conventional catalytic cracking stock
reaction terminating medium
15
14
18
19
13
1
1
gasoline stock
IV
III
II
I
11
3
8
2
pre-lifting medium
10
7
9
air
6
4
5

CATALYTIC CRACKING PROCESS FOR INCREASING SIMULTANEOUSLY THE YIELDS OF DIESEL OIL AND LIQUEFIED GAS

BACKGROUND OF THE INVENTION

The present invention relates to a process for catalytic cracking of hydrocarbon oils in the absence of hydrogen, and specifically relates to a process for catalytic cracking of petroleum hydrocarbon stocks in the absence of hydrogen to increase simultaneously the yields of diesel oil and liquefied gas.

Liquefied gas is one of the important petrochemical products, of which light olefins are important chemical raw materials of high commercial value. Diesel oil has high heat efficiency and the exhaust tail gas from vehicles running on diesel oil contains less harmful constituents, so it meets the more and more rigorous requirements for envirornental protection all over the world. Thus, following the increase in the number of vehicles running on diesel oil, the market demand for diesel oils is also growing.

Diesel oil comes mainly from fraction oils produced by the primary and secondary processing of crude oil. In the primary processing, i.e. the atmospheric and vacuum distillation, the yield of diesel fractions from crude oil is fixed, so no potential can be tapped. In the secondary processing, catalytic cracking is usually adopted for producing diesel oil. Featuring large-volume treatment and flexible operation conditions, this process of catalytic cracking is an important means for improving the yields of liquefied gas and diesel oil.

CN 1031834A discloses a catalytic cracking process for producing more light olefins. Although this process can produce large quantities of liquefied gas, but its yield of diesel oil is relatively low, generally less than 10 wt %, and moreover it requires a special catalyst and processing unit.

CN 1085885A discloses a method for obtaining higher yields of liquefied gas and gasoline under the following reaction conditions: a reaction temperature of 480°–580° C., a pressure of 130–350 KPa, a WHSV of 1–150 $h^{-1}$, a catalyst/oil ratio of 4–15, and a steam/hydrocarbon stock weight ratio of 0.05–0.12:1. The yield of liquefied gas in the reaction products is 30–40 wt %, but that of diesel oil is comparatively low.

CN 1160746A discloses a catalytic cracking process for raising the octane number of low-grade gasoline fractions, wherein a low-grade gasoline is introduced into a riser reactor through its lower part and the reaction is carried out under the conditions of a reaction temperature of 600°–730° C., a WHSV of 1–180 $h^{-1}$, and catalyst/oil ratio of 6–180, then a high octane gasoline, is mainly obtained. The feedstocks employed in this process are low-grade gasolines, such as straight-run gasoline, coker gasoline and so on, and the yields of liquefied gas and diesel oil in the reaction products are 24–39 wt % and 0.5–2.3 wt % respectively.

U.S. Pat. No. 3,784,463 discloses a process carried out in a reaction system comprising at least two riser reactors, wherein a low-grade gasoline is introduced into one of the riser reactors and catalytic cracking reaction occurs. By this process, the gasoline octane number and yield of liquefied gas are improved. However, this process cannot give higher yield of diesel oil, and it requires that the reaction unit should be revamped by adding at least another riser.

U.S. Pat. No. 5,846,403 discloses a process of recracking of catalytic naphtha to obtain a maximum yield of light olefins. The process is carried out in a riser reactor comprising two reaction zones, namely an upstream reaction zone in the lower part of the reactor and a downstream reaction zone in the upper part. In the upstream reaction zone, the feedstock is a light catalytic naphtha (having a boiling point below 140° C.), and the reaction conditions are: an oil-catalyst contact temperature of 620°–775° C., an oil and gas residence time of less than 1.5 sec., a catalyst/oil ratio of 75–150, and the proportion of steam accounting for 2–50 wt % the weight of naphtha, while in the downstream reaction zone, the feedstock is a conventional catalytic cracking stock (having a boiling point of 220°–575° C.), and the reaction conditions are: a temperature of 600°–750° C. and an oil and gas residence time of less than 20 sec. Compared with conventional catalytic cracking, the yields of liquefied gas and light cycle oil (i.e. diesel oil) of this process increase by 0.97–1.21 percentage points and 0.13–0.31 percentage points higher.

CN 1034949A discloses a process for converting petroleum hydrocarbons in which the stocks, ethane, gasoline, catalytic cracking stock and cycle oil, are successively upwardly introduced into a riser reactor through its lowermost part. This process is mainly aimed at producing light olefins, but the total yield of gasoline, diesel oil and liquefied gas decreases.

EP0369536A1 disclosed a process for catalytic cracking hydrocarbon feedstock, in which a hydrocarbon feedstock is charged into the lower part of the riser reactor wherein said hydrocarbon feedstock in admixed with freshly regenerated cracking catalyst, and a recycle portion of a light liquid hydrocarbon stream in charged into the riser zone at a level above the hydrocarbon feedstock charging level. The process operates in such a manner to produce maximum quantities of fuel oil, or alternatively to produce maximum quantities of olefins in different conditions, but can't increase the yields of diesel oil and of olefins simultaneously.

U.S. Pat. No. 4,422,925 discloses a process for fluidized catalytic cracking hydrocarbon feedstock for producing gaseous olefins, which comprises charging gaseous $C_2$ to $C_1$ rich stock into the lowermost portion of the riser reaction zone to contact with hot freshly regenerated catalyst and charging heavy hydrocarbon stock to an upper section of the riser, and introducing naphtha or gas oil into a section, between said lower and upper sections of said riser. This process can produce high yield of light olefins but the increment of yield of diesel oil is very small.

U.S. Pat. No. 3,894,932 disclosed a method for converting hydrocarbons which comprises passing $C_3$–$C_4$ gaseous hydrocarbon fraction through a lower portion of a riser, introducing gas oil at one or more spaced apart downstream intervals, and introducing $C_2$–$C_4$ hydrocarbon or isobutylene or gas oil through the upper portion of the riser. This method is aimed at producing aromatics and isobutane but can't increase the yields of diesel oil and liquefied gas simultaneously.

Another method of increasing the yield of liquefied gas is by adding a catalyst promoter to the catalytic cracking catalyst. For example, U.S. Pat. No. 4,309,280 discloses a method of adding a HZSM-5 zeolite in an amount of 0.01–1% by weight of the catalyst directly into the catalytic cracking unit.

U.S. Pat. No. 3,758,403 discloses a catalyst comprising ZSM-5 zeolite and large-pore zeolite (e.g. the Y-type and X-type) (in a ratio of 1:10–3:1)as active components, thereby raising the yield of liquefied gas and the gasoline octane number by a big margin, while the yields of propane and butane are increased by about 10 wt %. Furthermore, CN 1004878B, U.S. Pat. No. 4,980,053 and CN1043520A have disclosed catalysts comprising mixtures of ZSM-5 zeolite and Y-type zeolite as active components, resulting in that remarkable increases in the yield of liquefied gas are achieved. However, this kind of methods is used to mainly increase the yield of liquefied gas by means of modifying the catalysts, while the increase in the yield of diesel oil is less.

The above-mentioned patented processes can only increase the yield of liquefied gas, but cannot increase the yield of diesel simultaneously, or if any, the yield of diesel oil is insignificant. Moreover, some of the above-mentioned patented processes require special catalysts or reaction units, or the existing units should be largely refitted to meet their specific requirements.

The object of the present invention is to provide a catalytic cracking process for increasing the yields of diesel oil and liquefied gas simultaneously on the basis of the prior art.

SUMMARY OF THE INVENTION

The present invention relates to a process for catalytic cracking hydrocarbon stocks to increase simultaneously the yields of diesel oil and liquefied gas, carrying out in a riser or fluidized-bed reactor, which comprise:

(a) Gasoline stock, an optional pre-lifting medium, and a catalytic cracking catalyst are charged into the reactor through the bottom of the reactor and they contact in the lower zone of the reactor to produce an oil-gas mixture with a lot of liquefied gases;

(b) The resultant oil-gas mixture and the reacted catalyst from step (a) flow upwardly and contact, in the zone upper than the lower zone of the reactor, conventional catalytic feed introduced from at least two sites having different heights higher than the lower part of on the reactor, to produce an oil-gas mixture with a lot of diesel oils;

(c) The resultant oil-gas mixture from step (b) enters a fractionation system where it is separated into the desired liquefied gas, gasoline and diesel oil products, heavy cycle oil and slurry, wherein the heavy cycle oil and slurry are optionally circulated back to the reactor;

(d) The spent catalyst may pass through steam stripping and enters a regenerator and undergoes coke-burning and then is circulated back for reuse.

BRIEF DESCRIPTION OF THE DRAWING

The attached drawing is a schematic diagram of a riser reactor illustrating the flow of the catalytic cracking process provided by the present invention for increasing the yields of diesel oil and liquefied gas simultaneously. The parts of the riser reactor are indicated by the reference signs in the drawing an follows:

The reference signs 1, 2, 9, 10, 11, 13, 14, 15, 16, 17, 18 and 19 are for the pipelines; 3 for the riser reactor, wherein I is for gasoline cracking zone, II for heavy oil cracking zone, III for light oil cracking zone, and IV for termination reaction zone; 4 for disengaging section; 5 for steam stripper; 6 for slant pipe (spent catalyst); 7 for regenerator; 8 for slant pipe (regenerated catalyst); and 12 for fractionation system.

DETAILED DESCRIPTION OF THE INVENTION

The present invention relates to a process for catalytic cracking hydrocarbon stocks to increase simultaneously the yields of diesel oil and liquefied gas, carrying out in a riser or fluidized-bed reactor, which comprise:

(a) Gasoline stock, an optional pre-lifting medium, and a catalytic cracking catalyst are charged into the reactor through the bottom of the reactor and they contact in the lower zone of the reactor to produce am oil-gas mixture with a lot of liquefied gases;

(b) The resultant oil-gas mixture and the reacted catalyst from step (a) flow upwardly and contact, in the zone upper than the lower zone of the reactor, conventional catalytic cracking feed introduced from at least two sites having different heights higher than the lower part of on the reactor to produce an oil-gas mixture with a lot of diesel oils;

(c) The resultant oil-gap mixture from step (b) enters a fractionation system where it is separated into the desired liquefied gas, gasoline and diesel oil products, heavy cycle oil and slurry, wherein the heavy cycle oil and slurry are optionally circulated back to the reactor;

(d) The spent catalyst may pass through steam stripping and enters a regenerator and undergoes coke-burning and then is circulated back for reuse.

Particularly, the present invention relates to a process for catalytic cracking hydrocarbon stocks to give simultaneously higher yields of diesel oil and liquefied gas, carrying out in a riser or fluidized-bed reactor, wherein said reactor comprises a gasoline cracking zone, a heavy oil cracking zone, a light oil cracking zone and a optional termination reaction zone, wherein said process comprises the following steps:

(a) Gasoline stock and an optional pre-lifting medium are charged into the gasoline cracking zone of the reactor, contact a catalytic cracking catalyst to produce an oil-gas mixture, and then the resultant oil-gas mixture and reacted catalyst rise up and enter the heavy oil cracking zone;

(b) Conventional catalytic cracking feed solely, or mixed with slurry and/or heavy cycle oil, is charged into the reactor through the bottom of the heavy oil cracking zone, contact the oil-gas mixture and reacted catalyst rising from the gasoline cracking zone to produce an oil-gas mixture, and then the resultant oil-gas mixture and reacted catalyst rise up and enter the light oil cracking zone;

(c) Conventional catalytic cracking feed solely, or mixed with slurry and/or heavy cycle oil, is charged into the reactor through the bottom of the light oil cracking zone, contact the oil-gas mixture and reacted catalyst rising from the heavy oil cracking zone to produce an oil-gas mixture, and then the resultant oil-gas mixture and reacted catalyst rise up and enter an optional termination reaction zone;

d) A reaction terminating medium to optionally charged into the reactor through the bottom of the termination reaction zone to terminate the reaction, from where the resultant oil-gas mixture and catalyst flow forward to a disengaging section to separate; and (e) The reaction products are separated out in the fractionation system to obtain the desired liquefied gas, gasoline and diesel oil products, and the spent catalyst may pass through steam stripping and then enters a regenerator and undergoes coke-burning, and then is circulated back for reuse.

Among them said gasoline stock used in the gasoline cracking zone is a distillate oil having a boiling range of 30°–210° C. selected from straight-run gasoline, catalytic gasoline and coker gasoline, or mixtures thereof, preferably a catalytic gasoline fraction having $C_7^+$-205° C.; and it can also be a narrow fraction of gasoline of a certain stage, such as that having a boiling range of 90°–140° C. or 110°–210° C. Said gasoline stock may be fractions obtained from the present reaction unit per se or from other sources. Said pre-lifting medium is a dry gas or steam. The weight ratio of said pre-lifting medium to gasoline stock is in the range of 0–5:1.

In the gasoline cracking zone, the reaction temperature is about 500°–700° C., preferably about 620°–680° C., the reaction pressure is from atmospheric pressure to 300 KPa, preferably about 100–230 KPa; the residence time is about 0.1–3.0 sec, preferably about 0.2–1.5 sec; the weight ratio of catalyst to gasoline stock is about 10–150, preferably about 20–80; the weight ratio of gasoline stock to conventional catalytic cracking feed is about 0.02–0.50:1, preferably about 0.1–0.3:1; and the regenerated catalyst has a temperature of about 600°–750° C., preferably about 660°–710° C.

Said gasoline stock may be introduced from the bottom of the gasoline cracking zone or through spray nozzles arranged around the gasoline cracking zone, wherein the gasoline stock is cracked to form a liquefied gas and at the same time the sulfur and olefin contents in the gasoline are reduced while the gasoline octane number is raised. When hot catalyst comes into contact with the gasoline stock, its temperature reduces and simultaneously a trace of coke deposits on the catalyst, hence diminishing the activity of the catalyst and passivating the metals supported thereon, which is advantageous for increasing the yield of diesel oil. When the catalyst in this state contacts the conventional catalytic cracking feeds in the heavy oil cracking zone and light oil cracking zone, more diesel oil is produced. The resultant oil-gas mixture and reacted catalyst from the gasoline-cracking zone enter the heavy oil-cracking zone directly.

The conventional catalytic cracking feeds used in the heavy oil cracking zone and light oil cracking zone are selected at least one from straight-run gas oils, coker gas oils, deasphalted oils, hydrofined oils, hydrocracking tail oils, vacuum residues and atmospheric residues, or mixtures thereof. Said conventional catalytic cracking feed used in steps (b) and (c) may be the same or different. A portion of about 20–95 wt % of said conventional catalytic cracking feed solely, or mixed with slurry and/or heavy cycle oil, is charged into the heavy oil cracking zone; and a portion of about 5–80 wt % of said conventional catalytic cracking feed solely, or mixed with slurry and/or heavy cycle oil, is charged into the light oil cracking zone.

The function of heavy oil cracking zone is to control the cracking reaction of gasoline stock, to enhance the level of heavy oil cracking severity and to ensure the conversion of heavy oil fractions so as to increase the yield of diesel oil from the feedstock in the heavy oil cracking zone and improve the feedstock's selectivity to diesel oil in the light oil cracking zone. In the heavy oil cracking zone, the weight ratio of catalyst to feedstock is about 5–20, preferably about 7–15; the oil-gas mixture residence time is about 0.1–2 sec., preferably about 0.3–1.0 sec.; and the reaction pressure is from atmospheric pressure to 300 KPa, preferably about 100–230 KPa. The portion of feedstock to be processed in the heavy oil cracking zone is relatively heavier and more difficult to be cracked.

The function of light oil cracking zone is to carry out cracking of the conventional catalytic cracking feed in this zone under an environment formed through the controlling processes of the gasoline cracking zone and heavy oil cracking zone, which is beneficial for improving the feedstocks' selectivity to diesel oil in the heavy oil cracking zone and light oil cracking zone. In the light oil cracking zone, the weight ratio of catalyst to feedstock is about 3–15, preferably about 5–10; the oil-gas mixture residence time is about 0.1–6 sec., preferably about 0.3–3 sec.; and the reaction pressure is from atmospheric pressure 300 KPa, preferably about 100–230 KPa. The portion of feedstock to be processed in the light oil cracking zone is relatively lighter and easier to be cracked.

The recracking of heavy cycle oil and slurry is to convert unreacted fractions of them into valuable light oil products.

A termination reaction zone can be arranged after the light oil cracking zone. The function of the termination reaction zone is to diminish secondary cracking of light oils from the heavy oil cracking zone and light oil cracking zone, to increase the yield of diesel oil and to control the degree of conversion of the catalytic stocks as a whole. Said reaction terminating medium is selected at least one from waste water, softened water, recycle oils, heavy oil fractions, coker gas oils, deasphalted oils, straight-run gas oils and hydrocracking tail oils, or mixtures thereof. Depending on the type of reaction terminating medium used and the operation parameters in the heavy oil cracking zone and light oil cracking zone, particularly that of the light oil cracking zone, the weight ratio of reaction terminating medium to conventional catalytic cracking feed is about 0–30 wt %. Controlled by the quantity of terminating medium injected, the temperature in the reaction termination zone is in the range of about 470°–550° C., and the material residence time is about 0.2–3.0 sec.

The catalyst applicable in the process according to the present invention can be one comprising at least one active component selected from Y-type or HY-type zeolites with or without rare earth, ultra-stable Y-type zeolites with or without rare earth, zeolites of ZSM-5 series, or high-silica zeolites having pentatomic ring structure and β-zeolites, or mixtures thereof, and can also be an amorphous silica-alumina catalyst. In short, all the catalytic cracking catalysts can be applied in the process according to the present invention.

Said riser or fluidized bed reactor comprising a gasoline cracking zone, a heavy oil cracking zone, a light oil cracking zone and a termination reaction zone has a total height of 10–50 m, wherein the heights of the zones account for 2–20%, 2–40%, 2–60% and 0–40% respectively; more accurately, the height of each of the four zones is determined in accordance with the specific operating parameters required in each reaction zone.

The process according to the present invention can be carried out in conventional catalytic cracking reactors. However, since the gasoline cracking zone in certain existing catalytic cracking units is too long, it has to be refitted, for example, the feed inlet in the gasoline cracking zone has to be rearranged at a higher location. The present process can also be carried out in reactors with a gasoline cracking zone of different structures.

The process of the present invention is further illustrated with reference to the attached drawing (exemplified with riser reactor).

The flow scheme shows the catalytic cracking process f or higher yields of both diesel oil and liquefied gas, but the shape and dimensions of the riser reactor are not restricted to what is shown in the schematic diagram, whereas they are determined by the specific conditions of operation.

The flow scheme of the process according to the present invention is as follows:

A gasoline stock and a pre-lifting medium from pipelines 1 and 2 respectively are charged in a preset ratio into the riser reactor 3 through a location at a height of 0–80% of the gasoline cracking zone I contact a catalyst, which is a fresh one or a regenerated one, and then the resultant oil-gas mixture and reacted catalyst rise up and enter the heavy oil cracking zone II; a portion of conventional catalytic cracking feed solely from pipeline 13, or mixed with a recycling slurry from pipeline 16 and/or heavy cycle oil from pipeline 17, is charged into the reactor via pipeline 13 through the bottom of the heavy oil cracking zone II contacts the reactant oil-gas mixture and catalyst rising from the gasoline cracking zone, and then the resultant oil-gas mixture and reacted catalyst rise up and enter the light oil cracking zone III, another portion of conventional catalytic cracking feed solely from pipeline 14, or mixed with a recycling slurry from pipelines 16 and 18 and/or heavy cycle oil from pipelines 17 and 19, is charged into the reactor via pipeline 14 through the bottom of the light oil cracking zone contacts the reactant oil-gas mixture and catalyst rising from the heavy oil cracking zone, and then the resultant oil-gas mixture and reacted catalyst rise up and enter the termination reaction zone IV; optionally, a reaction terminating medium from pipeline 15 is charged into the reactor through the bottom of the termination reaction zone IV, from which the reactant oil-gas mixture and spent catalyst flow into the disengaging section 4 with or without a dense fluidized bed reactor, and then the oil-gas mixture and steam via pipeline 11 enter the fractionation system 12 and are separated into dry gas, liquefied gas, gasoline, diesel oil, heavy cycle oil and slurry, and then the slurry can be circulated back to the heavy oil cracking zone via pipelines 16 and 13 in sequence, or to the light oil cracking zone via pipelines 16, 18 and 14 in sequence; and the heavy cycle oil can be circulated back to the heavy oil cracking zone via pipelines 17 and 13 in sequence, or to the light oil cracking zone via pipelines 17, 19 and 14 in sequence. The spent catalyst enters the steam stripper 5 for steam stripping, and then enters the regenerator 7 via the slant pipe 6 to undergo coke-burning and regeneration in the presence of air; the air is introduced into the regenerator 7 via pipeline 9, and flue gas is discharged therefrom via pipeline 10, and the hot regenerated catalyst is circulated back to the bottom of the gasoline cracking zone of the riser reactor for reuse.

The advantages of the present invention are embodied in the following points:

1. The process of the present invention can be carried out in an existing conventional catalytic cracking unit, which need not to be revamped in large scale, and it does not require special catalyst either, while the yields of liquefied gas and diesel oil can be increased by a big margin;
2. In the gasoline cracking zone, when the gasoline stock and hot catalyst comes into contact, a trace of coke deposited on the catalyst will cause passivation of the metals supported on the catalyst, hence reducing the adverse effects of the metals on product distribution. Since a large portion of strong acid sites on the zeolite and the matrix are covered by the trace of coke, this is beneficial for inhibiting coke-forming tendency during cracking of conventional catalytic cracking feed as well an for improving the selectivity to diesel oil;
3. In respect of the portion of relatively light fractions in the feedstock which can be easily cracked, the measures of operating at lower temperature with less rigorous reaction severity, shorter contact cracking and preventing secondary cracking can effectively improve the selectivity to diesel oil;
4. As sulfur contained in the gasoline stock is mainly distributed in the heavy components, the reaction in the gasoline cracking zone of the riser reactor occurs to crack selectively the heavy components therein, thus the sulfur content can be reduced remarkably;
5. In the process according to the present invention, the gasoline stock injected into the reactor can substitute completely or partially for the pre-lifting steam, as a result, the energy consumption of the reaction unit and waste water discharged therefrom are reduced, so this is beneficial for environment protection as well as for diminishing hydrothermal deactivation of the catalyst; and
6. The gasoline octane number can be maintained at a higher level or raised, while olefins of gasoline can be reduced.

EXAMPLES

The process of the present invention is further illustrated by the following non-limiting examples.

The properties of feedstocks and catalysts used in the examples are shown in Tables 1 and 2, respectively. The conventional catalytic cracking feed used was vacuum gas oil mixed with 17 wt %, 18 wt % of vacuum residues, and the gasoline stocks were the catalytic gasolines formed in the reaction unit. Catalysts A and B were products of the Qilu Catalysts Plant of the SINOPEC, and catalyst C was a product of the Lanzhou Catalysts Plant of the CNPC.

Example 1

This example was conducted to demonstrate that the yields of liquefied gas and diesel oil can be increased simultaneously by the process of the present invention. The process was carried out in a pilot plant riser reactor.

The total height of the reactor was 10 m, wherein the heights of the gasoline cracking zone, heavy oil cracking zone, light oil cracking zone and termination reaction zone were 1 m, 2 m, 5 m, and 2 m, respectively.

The pre-lifting steam and catalytic gasoline (having a RON and MON of 92.4 and 79.1 respectively and an olefin content of 47.5 wt %) in a weight ratio of 0.05:1 were charged into the reactor through a location at a height of 40% the height of the gasoline cracking zone, contacted catalyst A, and then the resultant oil-gas mixture and reacted catalyst rose up and entered the heavy oil cracking zone; a portion of 65 wt % of stock A and 100 wt % of heavy cycle oil were charged into the reactor through the bottom of heavy oil cracking zone, contacted the reactant oil-gas mixture and catalyst from the gasoline cracking zone, and then the resultant oil-gas mixture and reacted catalyst rose up and entered the light oil cracking zone; a portion of 35 wt % of stock A was charged into the reactor through the bottom of light oil cracking zone, contacted the reactant oil-gas mixture and catalyst from the heavy oil cracking zone, and then the resultant oil-gas mixture and reacted catalyst rose up and entered the termination reaction zone; softened water in an amount of 5% by weight of stock A was charged into the reactor through the bottom of the termination reaction zone; then, the resultant oil-gas mixture and reacted catalyst flowed to the separation system; then the reaction products were separated out, and the spent catalyst, passing through steam stripping, entered the regenerator and, after coke-burning, the regenerated catalyst was circulated back for reuse. The weight ratio of catalytic gasoline to stock A was 0.20:1.

The reaction conditions and product distribution are shown in Table 3, from which it can be seen that the yield of liquefied gas is 16.34 wt %, and the yield of diesel oil is 27.81 wt %. The properties of gasoline products are shown in Table 4, from which it can be seen that the gasoline products have RON and MON of 93.2 and 80.5 respectively, an olefin content of 37.8 wt % and sulfur content of 760 ppm.

Comparative Example 1

This comparative example was conducted to demonstrate the yields of liquefied gas and diesel oil obtained from a conventional catalytic feedstock in a conventional non-sectional catalytic cracking riser reactor. The process was carried out in a pilot plant riser reactor having a total height of 10 m.

The feedstock and catalyst used in this comparative example were the same respectively as those used in Example 1. The reaction conditions and product distribution are shown in Table 3, from which it can be seen that the yield of liquefied gas is only 13.23 wt %, 3.11 percentage points lower than that obtained in Example 1; and the yield of diesel oil is only 25.72 wt %, 1.79 percentage points lower than that obtained in Example 1. The properties of the gasoline products are shown in Table 4, from which it can be seen that the gasoline products have a RON and MON of 92.4 and 79.1 respectively, an olefin content of 47.5 wt % and a sulfur content of 870 ppm.

Example 2

This example was conducted to demonstrate that the yields of liquefied gas and diesel oil can be increased simultaneously by the process of the present invention. The process was carried out in the same reactor as that used in Example 1.

The pre-lifting steam and catalytic gasoline (having a RON and MON of 92.6 and 79.4 respectively and an olefin content of 46.1 wt %) in a weight ration of 0.10:1 were charged into the reactor through a location at a height of 60% the height of the gasoline cracking zone, contacted catalyst B, and then the resultant oil-gas mixture and reacted catalyst rose up and entered the heavy oil cracking zone; a portion of 40 wt % of stock A and all the slurry and heavy cycle oil were charged into the reactor through the bottom of heavy oil cracking zone, contacted the reactant oil-gas mixture and catalyst from the gasoline cracking zone, and then the resultant oil-gas mixture and reacted catalyst rose up and entered the light oil cracking zone; a portion of 60 wt % of stock A and all the recycling heavy cycle oil were charged into the reactor through the bottom of light oil cracking zone, contacted the reactant oil-gas mixture and catalyst from the heavy oil cracking zone, and then the resultant oil-gas mixture and reacted catalyst rose up and entered the termination reaction zone; softened water in an amount of 10% by weight of stock A was charged into the reactor through the bottom of the termination reaction zone; then, the resultant oil-gas mixture and reacted catalyst flowed to the separation system; then the reaction products were separated out, and the spent catalyst, passing through steam stripping, entered the regenerator and, after coke-burning, the regenerated catalyst was circulated back for reuse. The weight ratio of catalytic gasoline stock to stock A was 0.08:1.

The reaction conditions and product distribution are shown in Table 5, from which it can be seen that the yield of liquefied gas is 16.68 wt %, and the yield of diesel oil is 27.56 wt %. The properties of gasoline product are shown in Table 6, from which it can be seen the gasoline products have RON and MON of 92.8 and 80.2 respectively, an olefin content of 43.4 wt % and a sulfur content of 601 ppm.

Comparative Example 2

This comparative example was conducted to demonstrate the yields of liquefied gas and diesel oil obtained from a conventional catalytic feedstock in a conventional non-sectional catalytic cracking riser reactor. The process was carried out in a pilot plant riser reactor having a total height of 10 m.

The feedstock and catalyst used in this comparative example were the same respectively as the conventional catalytic cracking feed and catalyst used in Example 2. The reaction conditions and product distributions are shown in Table 5, from which it can be seen that, in the absence of a gasoline stock, the yield of liquefied gas is only 15.23 wt %, 1.36 percentage points lower than that obtained in Example 2; and the yield of diesel oil is only 25.79 wt %, 1.77 percentage points lower than that obtained in Example 2. The properties of the gasoline products are shown in Table 6, from which it can be seen that the gasoline products have a RON and MON of 92.6 and 79.4 respectively, an olefin content of 46.1 wt % and a sulfur content of 850 ppm.

Example 3

This example was conducted to demonstrate that the yields of liquefied gas and diesel oil can be increased simultaneously by the process of the present invention. The process was carried out in a pilot plant riser reactor, the same as that used in Example 1.

The pre-lifting steam and catalytic gasoline (having a RON and MON of 92.6 and 79.4 a respectively and an olefin content of 46.1 wt %) in a weight-ratio of 0.06:1 were charged into the reactor through a location at a height of 40% the height of the gasoline cracking zone, contacted the catalyst B, and then the resultant oil-gas mixture and reacted catalyst rose up and entered the heavy oil cracking zone; a stock A of 75 wt % and all the recycling slurry were charged into the reactor through the bottom of heavy oil cracking zone, contacted the oil-gas mixture and catalyst from the gasoline cracking zone, and then the resultant oil-gas mixture and reacted catalyst rose up and entered the light oil cracking zone; a stock A of 25 wt % and all the recycling heavy cycle oil were charged into the reactor through the bottom of light oil cracking zone, contacted the oil-gas mixture and catalyst from the heavy oil cracking zone, and then the resultant oil-gas mixture and reacted catalyst rose up and entered the termination reaction zone; softened water in an amount of 5% by weight of stock A was charged into the reactor through the bottom of the termination reaction zone; then, the resultant oil-gas mixture and reacted catalyst flowed to the separation system; then the reaction products were separated out, and the spent catalyst, passing through steam stripping, entered the regenerator and, after coke-burning, the regenerated catalyst was circulated back for reuse. The weight ratio of catalytic gasoline stock to stock A was 0.15:1.

The reaction conditions and product distribution are shown in Table 5, from which it can be seen that the yield of liquefied gas is 18.44 wt %, and the yield of diesel oil is 28.00 wt %. The properties of gasoline products are shown in Table 6, from which it can be seen that the gasoline products have RON and MON of 93.6 and 80.7 respectively, an olefin content of 39.9 wt % and a sulfur content of 780 ppm.

Example 4

This example was conducted to demonstrate that the yields of liquefied gas and diesel oil can be increased simultaneously by the process of the present invention. The process was carried out in a pilot plant riser reactor, the same as that used in Example 1.

The pre-lifting steam and catalytic gasoline (having a RON and MON of 90.1 and 79.8 respectively-and an olefin content of 51.2 wt %) in a weight ratio of 0.09:1 were charged into the reactor through a location at a height of 20% the height of the gasoline cracking zone, contacted the catalyst C, and then the resultant oil-gas mixture and reacted catalyst rose up and entered the heavy oil cracking zone; a stock B of 60 wt % and a portion of 80 wt % of the recycling slurry were charged into the reactor through the bottom of heavy oil cracking zone, contacted the reactant oil-gas mixture and catalyst from the gasoline cracking zone, and then the resultant oil-gas mixture and reacted catalyst rose up and entered the light oil cracking zone; a stock B of 40 wt % and all the recycling heavy cycle oil were charged into the reactor through the bottom of light oil cracking zone, contacted the reactant oil-gas mixture and catalyst from the heavy oil cracking zone, and then the resultant oil-gas mixture and reacted catalyst rose up and entered the termination reaction zone; catalytic gasoline in an amount of 5% by weight of stock B was charged into the reactor through the bottom of the termination reaction zone; then, the resultant oil-gas mixture and reacted catalyst flowed to the separation system; then the reaction products were separated out, and the spent catalyst, passing through steam stripping, entered the regenerator and, after coke-burning, the regenerated catalyst was circulated back for reuse. The weight ratio of catalytic gasoline stock to stock B was 0.10:1.

The reaction conditions and product distribution are shown in Table 7, from which it can be seen that the yield of liquefied gas is 20.49 wt %, and the yield of diesel oil is 28.45 wt %. The properties of gasoline products are shown in Table 8, from which it can be seen that the gasoline products have RON and MON of 90.5 and 80.2 respectively, an olefin content of 45.9 wt % and a sulfur content of 314 ppm.

Comparative Example 3

This comparative example was conducted to demonstrate the yields of liquefied gas and diesel oil obtained from a conventional catalytic feedstock in a conventional non-sectional catalytic cracking riser reactor. The process was carried out in a pilot plant riser reactor having a total height of 10 m.

The feedstock and catalyst used in this comparative example were the same respectively as the conventional catalytic cracking feed and catalyst used in Example 4. The reaction conditions and product distributions are shown in Table 7, from which it can be seen that, in the absence of a gasoline stock, the yield of liquefied gas is only 18.48 wt %, 2.01 percentage points lower than that obtained in Example 4; and the yield of diesel oil is only 26.61 wt %, 1.84 percentage points lower than that obtained in Example 4. The properties of the gasoline products are shown in Table 8, from which it can be seen that the gasoline products have a RON and MON of 79.8 and 90.1 respectively, an olefin content of 51.2 wt % and a sulfur content of 394 ppm.

Example 5

This example was conducted to demonstrate that the yields of liquefied gas and diesel oil can be increased simultaneously by the process of the present invention. The process was carried out in a pilot plant riser reactor, the same as that used in Example 1.

The catalytic gasoline (having a RON and MON of 90.1 and 79.8 respectively and an olefin content of 51.2 wt %) was charged into the reactor through a the bottom of the gasoline cracking zone, contacted the catalyst C, and then the resultant oil-gas mixture and reacted catalyst rose up and entered the heavy oil cracking zone; 100 wt % of stock B and all the recycling slurry were charged into the reactor through the bottom of heavy oil cracking zone, contacted the reactant oil-gas mixture and catalyst from the gasoline cracking zone, and then the resultant oil-gas mixture and reacted catalyst rose up and entered the light oil cracking zone; all the recycling heavy cycle oil were charged into the reactor through the bottom of light oil cracking zone, contacted the oil-gas mixture and catalyst from the heavy oil cracking zone, and then the resultant oil-gas mixture and reacted catalyst rose up and entered the termination reaction zone; catalytic gasoline in an amount of 10 wt % the weight of stock B was charged into the reactor through the bottom of the termination reaction zone; then, the resultant oil-gas mixture and reacted catalyst flowed to the separation system; then the reaction products were separated out, and the spent catalyst, passing through steam stripping, entered the regenerator and, after coke-burning, the regenerated catalyst was circulated back for reuse. The weight ratio of catalytic gasoline stock to stock B was 0.049:1.

The reaction conditions and product distribution are shown in Table 7, from which it can be seen that the yield of liquefied gas is 18.98 wt %, and the yield of diesel oil is 27.04 wt %. The properties of gasoline products are shown in Table 8, from which it can be seen that the gasoline products have RON and MON of 90.3 and 79.8 respectively, an olefin content of 48.8 wt % and a sulfur content of 365 ppm.

TABLE 1

| Conventional catalytic cracking feed | A | B |
|---|---|---|
| Composition of Conventional catalytic cracking feed, wt % | | |
| Vacuum gas oil | 82 | 83 |
| Vacuum residue | 18 | 17 |
| Density (20 ° C.), g/cm$^3$ | 0.9053 | 0.8691 |
| Viscosity, mm$^2$/sec | | |
| 80° C. | 23.88 | 7.999 |
| 100° C. | 13.60 | 5.266 |
| Conradson residue, wt % | 2.3 | 1.65 |
| Pour point, ° C. | 45 | 33 |
| Group composition, wt % | | |
| Saturates | 61.3 | 77.9 |
| Aromatics | 27.8 | 14.2 |
| Resin | 10.3 | 7.5 |
| Asphaltenes | 0.6 | 0.4 |
| Elementary composition, wt % | | |
| Carbon | 86.27 | 86.21 |
| Hydrogen | 12.60 | 13.36 |
| Sulfur | 1.12 | 0.27 |
| Nitrogen | 0.23 | 0.27 |
| Metal contents, ppm | | |
| Fe | 10.4 | — |
| Ni | 3.5 | — |
| Cu | <0.1 | — |
| V | 3.9 | — |
| Na | <0.1 | — |

TABLE 1-continued

| Conventional catalytic cracking feed | A | B |
|---|---|---|
| Distillation range, ° C. | | |
| IBP | 268 | 213 |
| 5% | 370 | 301 |
| 10% | 400 | 328 |
| 30% | 453 | 375 |
| 50% | 480 | 418 |
| 70% | 521 | 466 |
| Dry point | — | |

TABLE 2

| Catalyst | A | B | C |
|---|---|---|---|
| Trade Name | RHZ-300 | MLC-500 | LV-23 |
| Chemical composition, wt % | | | |
| $Al_2O_3$ | 42.0 | 44.7 | 51.7 |
| $Fe_2O_3$ | 0.42 | 0.38 | 0.40 |
| Physical properties | | | |
| Specific surface area, $m^2/g$ | 182 | 203 | 220 |
| Pore volume, ml/g | 1.93 | 2.14 | 2.39 |
| Apparent density, $g/cm^3$ | 0.8382 | 0.7921 | 220.7654 |
| Screen composition, % | | | |
| 0–40 μm | 7.4 | 8.5 | 22.4 |
| 0–80 μm | 66.4 | 66.3 | — |
| 0–110 μm | 90.0 | 87.2 | 81.9 |
| 0–150 μm | 98.9 | 95.9 | — |

TABLE 3

| | Example 1 | Comp. Ex. 1 |
|---|---|---|
| Pre-lifting steam/gasoline stock weight ratio | 0.05 | — |
| Pre-lifting stock/conventional catalytic cracking feed weight ratio | 0.20 | 0 |
| Catalyst | A | A |
| Reaction conditions | | |
| Temperature, ° C. | | 500 |
| Gasoline cracking zone | 640 | — |
| Heavy oil cracking zone | 580 | — |
| Light oil cracking zone | 507 | — |
| Residence time, sec. | | 1.9 |
| Gasoline cracking zone | 1 | — |
| Heavy oil cracking zone | 0.4 | — |
| Light oil cracking zone | 1 | — |
| Catalyst/oil ratio | | 5 |
| Gasoline cracking zone | 25 | — |
| Heavy oil cracking zone | 6.7 | — |
| Light oil cracking zone | 5 | — |
| Pressure (gauge), KPa | 90 | 90 |
| Regenerated catalyst temp., ° C. | 680 | 660 |
| Product distribution, wt % | | |
| Dry gas | 3.56 | 3.08 |
| Liquefied gas | 16.34 | 13.23 |
| Gasoilne | 37.96 | 43.61 |
| Diesel oil | 26.51 | 24.72 |
| Slurry | 9.25 | 9.23 |
| Coke | 6.38 | 6.13 |
| Total | 100.00 | 100.00 |

TABLE 4

| | Example 1 | Com. Example 1 |
|---|---|---|
| Density (20° C.), $kg/m^3$ | 0.7614 | 0.7503 |
| Octane number | | |
| RON | 93.2 | 92.4 |
| MON | 80.5 | 79.1 |
| Olefin content, wt % | 37.8 | 47.5 |
| Induction period, min. | 632 | 545 |
| Existent gum, mg/l00 ml | 2 | 3 |
| Sulfur, ppm | 760 | 870 |
| Nitrogen, ppm | 21 | 27 |
| Carbon, wt % | 87.20 | 86.65 |
| Hydrogen, wt % | 12.75 | 13.26 |
| Distillation range, ° C. | | |
| IBP | 45 | 41 |
| 10% | 76 | 71 |
| 30% | 106 | 99 |
| 50% | 127 | 123 |
| 70% | 148 | 148 |
| 90% | 169 | 171 |
| EBP | 192 | 195 |

TABLE 5

| | Example 2 | Comp. Ex 2 | Example 3 |
|---|---|---|---|
| Steam/gasoline stock weight ratio | 0.10 | — | 0.06 |
| Gasoline stock/conventional catalytic cracking feed weight ratio | 0.08 | 0 | 0.15 |
| Catalyst | B | B | B |
| Reaction conditions | | | |
| Temperature, ° C. | | 500 | |
| Gasoline cracking zone | 660 | — | 645 |
| Heavy oil cracking zone | 610 | — | 590 |
| Light oil cracking zone | 500 | — | 500 |
| Residence time, sec. | | 1.83 | |
| Gasoline cracking zone | 0.3 | — | 1.1 |
| Heavy oil cracking zone | 0.4 | — | 0.3 |
| Light oil cracking zone | 1.89 | — | 1.93 |
| Catalyst/oil ratio | | 6.2 | |
| Gasoline cracking zone | 77 | — | 41.3 |
| Heavy oil cracking zone | 10.3 | — | 8.3 |
| Light oil cracking zone | 6.2 | — | 6.2 |
| Pressure (gauge), KPa | 150 | 150 | 150 |
| Regenerated catalyst temp., ° C. | 675 | 670 | 678 |
| Product distribution, wt % | | | |
| Dry gas | 3.13 | 2.90 | 3.83 |
| Liquefied gas | 16.68 | 15.32 | 18.44 |
| Gasoline | 42.73 | 46.61 | 40.03 |
| Diesel oil | 27.56 | 25.79 | 28.26 |
| Coke | 9.05 | 8.57 | 8.78 |
| Loss | 0.85 | 0.81 | 0.66 |
| Total | 100.00 | 100.00 | 100.00 |

What is claimed is:

1. A process for catalytically cracking hydrocarbon stocks in a riser or fluidized bed reactor, comprising the steps of:

(a) charging a gasoline stock and a catalytic cracking catalyst into a lower zone of the reactor to permit contact between the catalyst and the gasoline stock and to produce a liquefied gas-rich oil-gas mixture containing reacted catalyst;

(b) introducing the liquefied gas-rich oil-gas mixture with reacted catalyst produced in step (a) into a reaction zone above the lower zone of the reactor and further introducing at least one conventional catalytic hydrocarbon feed independently into at least two sites in said upper zone, each site having a different height above the lower zone of the reactor, to produce a diesel-rich oil-gas mixture; and (c) separating the resulting oil-gas mixture produced in step (b) in a fractionation system into liquefied gas, gasoline and diesel oil products, heavy cycle oil, and slurry.

2. A process according to claim 1, wherein said gasoline stock in step (a) is a distillate oil having a boiling range of 30°–210° C. selected from at least one member selected from the group consisting of straight-run gasoline, catalytic gasoline and coker gasoline, and mixtures thereof, and said conventional catalytic cracking feed is selected from at least one member selected from the group consisting of straight-run gas oil, coker gas oil, deasphalted oil, hydrofined oil, hydrocracking tail oil, vacuum residue and atmospheric residue, and mixtures thereof.

3. A process according to claim 1, wherein the reaction temperature in step (a) is about 500–700° C., the reaction pressure is in the range of from atmospheric pressure to 300 KPa, the residence time is about 0.1–3.0 sec., the weight ratio of catalyst to gasoline stock is about 10–150, and the temperature of the regenerated catalyst in step (c) is about 600–750° C.

4. A process according to claim 1, wherein the weight ratio of catalyst to conventional catalytic cracking feed in step (b) is about 3–15, and the residence time is about 0.1–6 sec.

5. A process according to claim 1, further including the step of charging said gasoline stocks into the lower zone of the reactor with a pre-lifting medium.

6. A process according to claim 1, including the step of recycling at least a portion of the heavy cycle oil and slurry produced in step (c) to the reactor.

7. A process according to claim 1, further including the step of separating any spent catalyst from the oil-gas mixture produced in step (b) and steam-stripping and regenerating the spent catalyst by coke-burning in a regenerator.

8. A process according to claim 7, further including the step of recirculating the regenerated catalyst to said reactor.

9. A process for catalytically cracking hydrocarbon stocks in a riser or fluidized bed reactor, wherein said reactor comprises a gasoline cracking zone, a heavy oil cracking zone, and a light oil cracking zone, comprising the steps of:

(a) charging gasoline stocks to the gasoline cracking zone to contact said gasoline stock with a catalytic cracking catalyst to produce an oil-gas mixture, (b) passing the resultant oil-gas mixture and reacted catalyst of step (a) into the heavy oil cracking zone;

(c) charging at least one stock selected from the group consisting of catalytic cracking feed, a mixture of catalytic cracking feed and slurry, a mixture of catalytic cracking feed and heavy cycle oil, and a mixture of catalytic cracking feed, slurry, and heavy oil, into the heavy oil cracking zone and contacting the oil-gas mixture and catalyst from step (a) to produce an oil-gas mixture containing reacted catalyst, (d) passing the resultant oil-gas mixture and reacted catalyst from step (c) into the light oil cracking zone;

(e) charging at least one member selected from the group consisting of catalytic cracking feed, a mixture catalytic cracking feed and slurry, a mixture of catalytic cracking feed and heavy cycle oil, and a mixture of catalytic cracking feed, slurry, and heavy cycle oil into the light oil cracking zone to contact the oil-gas mixture and reacted catalyst provided in step (c) to produce a product stream containing a oil-gas mixture and obtain spent catalyst.

10. A process according to claim 9, wherein said pre-lifting medium is dry gas or steam, the weight ratio of the prelifting medium to the gasoline stock is 0–5:1.

11. A process according to claim 9, wherein said gasoline stock in the gasoline cracking zone is a distillate oil having a boiling range of 30°–210° C. selected from at least one of straight-run gasoline, catalytic gasoline and coker gasoline, or mixtures thereof.

12. A process according to claim 11, wherein said gasoline stock in the gasoline cracking zone is a catalytic gasoline fraction of $C_7^+$–205° C.

13. A process according to claim 9, wherein the gasoline cracking zone has a reaction temperature of about 500–700° C., a reaction pressure is in the range of from atmospheric pressure to 300 KPa, a residence time is about 0.1–3.0 sec., and a weight ratio of catalyst to gasoline stock is about 10–150.

14. A process according to claim 13, wherein the gasoline cracking zone has a reaction temperature of about 620–680° C., a reaction pressure is about 100–230 KPa, a residence time is about 0.2–1.5 sec., and a weight ratio of catalyst to gasoline stock is about 20–80.

15. A process according to claim 9, wherein the heavy oil cracking zone has a weight ratio of catalyst to feedstock of about 5–20, and a residence time is about 0.1–2 sec, and the light oil cracking zone has a weight ratio of catalyst to feedstock of about 3–15, and a residence time of about 0.1–6 sec.

16. A process according to claim 15, wherein the heavy oil cracking zone has a weight ratio of catalyst to feedstock of about 7–15, and a residence time is about 0.3–1 sec., and the light oil cracking zone has a weight ratio of catalyst to feedstock of about 5–10, and a residence time of about 0.2–3 sec.

17. A process according to claim 9, wherein said conventional catalytic cracking feed is selected from the group consisting of straight-run gas oil, coker gas oil, deasphalted oil, hydrofined oil, hydrocracking tail oil, vacuum residue and atmospheric residue, and mixtures thereof.

18. A process according to claim 9, wherein the weight ratio of said feed used in step (b) to said feed used in step (c) is about 20–95:80–5.

19. A process according to claim 9, wherein gasoline stock and conventional catalytic cracking feed is fed to the reactor in a weight ratio of gasoline stock to conventional catalytic cracking feed of about 0.02–0.50:1.

20. A process according to claim 9, wherein the total height of said reactor is 10–50 m, of which the heights of gasoline cracking zone, heavy oil cracking zone, light oil cracking and termination reaction zone are 2–20%, 2–40%, 2–60% and 0–40%, respectively.

21. A process according to claim 9, including a further step of introducing a pre-lifting medium into the gasoline cracking zone of the reactor.

22. A process according to claim 9, wherein the reactor further includes a reaction termination zone, comprising the steps of:

introducing the resultant oil-gas mixture and reacted catalyst of step (d) into the reaction terminating zone, and introducing a reaction terminating medium into the reaction termination zone.

23. A process according to claim 22, wherein said reaction terminating medium is selected from the group consisting of waste water, softened water, catalytic gasoline, coker gasoline, straight-run gasoline, cycle oil stock, heavy oil fraction, coker gas oil, deasphalted oil, straight-run gas oil and hydrocracking tail oil, or mixtures thereof, and said reaction terminating medium accounts for 0–30 wt % of the conventional catalytic cracking feed.

24. A process according to claim 9, further including the step of passing the resulting oil-gas mixture and reacted catalyst of step (e) to a disengaging section.

25. A process according to claim 9, including the step of separating said oil-gas mixture from step (e) in a fractionation system to obtain liquefied gas and gasoline and diesel oil products.

26. A process according to claim 9, further including the step of separating any spent catalyst from the produced in step (e) and steam-stripping and regenerating the spent catalyst by coke-burning in a regenerator.

* * * * *